US012747569B2

(12) United States Patent
Blamble

(10) Patent No.: US 12,747,569 B2
(45) Date of Patent: Sep. 29, 2026

(54) TILE WALL DRAIN

(71) Applicant: David Blamble, Bellevue, NE (US)

(72) Inventor: David Blamble, Bellevue, NE (US)

( * ) Notice: Subject to any disclaimer, the term of this patent is extended or adjusted under 35 U.S.C. 154(b) by 96 days.

(21) Appl. No.: 18/674,318

(22) Filed: May 24, 2024

(65) Prior Publication Data

US 2024/0392547 A1 Nov. 28, 2024

Related U.S. Application Data

(60) Provisional application No. 63/468,645, filed on May 24, 2023.

(51) Int. Cl.
*E03C 1/22* (2006.01)
*A47K 3/40* (2006.01)

(52) U.S. Cl.
CPC . *E03C 1/22* (2013.01); *A47K 3/40* (2013.01)

(58) Field of Classification Search
CPC ..... E03C 1/22; A47K 3/40; E03F 5/0408
See application file for complete search history.

(56) References Cited

U.S. PATENT DOCUMENTS

| | | | | |
|---|---|---|---|---|
| 9,611,634 | B2 * | 4/2017 | Erlebach | E03F 5/0408 |
| 10,017,933 | B1 * | 7/2018 | Kirby | E03F 5/0408 |
| 10,550,563 | B1 * | 2/2020 | Kozlowski | E03C 1/22 |
| 11,454,017 | B2 * | 9/2022 | Larson | E03F 5/0408 |
| 11,613,883 | B2 * | 3/2023 | Bernoti | E03F 5/0408 210/163 |

* cited by examiner

*Primary Examiner* — Janie M Loeppke
(74) *Attorney, Agent, or Firm* — Kutak Rock LLP; Ryan S. Hinderliter

(57) ABSTRACT

A tile drain system and method are provided. The tile drain system is configured for installation at the base of a wall within a tile basin and includes a drain body made up of a main drain piece, drain extension piece(s), end cap(s), and magnet holder(s); a grate; and magnets. In embodiments, the tile drain system can be easily cut down to size. The main drain piece includes an opening for engagement with a wastewater drain line. An upper portion of the drain body comprises a shelf along the length of the drain. The shelf is configured to receive and support wall board. A portion of the drain body is configured to be overlayed by tile(s) of a tile wall. The tile drain system further includes magnet holder(s) configured to house magnet(s) which magnetically interact with the drain grate.

17 Claims, 19 Drawing Sheets

TILE WALL DRAIN

CROSS-REFERENCE TO RELATED APPLICATIONS

This application claims priority pursuant to 35 U.S.C. 119 (e) to U.S. Provisional Patent Application Ser. No. 63/468,645, filed May 24, 2023, the entire disclosure of which is incorporated herein by reference.

FIELD OF THE INVENTION

The present invention relates generally to plumbing drains. More specifically, the present invention relates to a drain particularly well suited for use in tiled showers, basins, or the like.

BACKGROUND OF THE INVENTION

Tile basins for showers and the like are extremely popular in interior design today. Typically, a tile basin is constructed by first placing a cement backer board over a subfloor at the desired location. Next a bottom waterproofing layer is applied to the cement board. Concrete is then poured over the bottom waterproofing layer, and a top waterproofing layer is applied to the concrete after it has hardened. Finally, the tile is applied above the top waterproofing layer. The cement board, the bottom waterproofing layer, and the concrete are all installed around the housing of a drain for the basin. It would be beneficial to have a tile basin drain which is simple to install.

Furthermore, some consumers find standard tile basin circular drains to be bland or even unsightly. Particularly for higher end homes, sleek, modern-looking designs are desirable to many consumers. Accordingly, it would be beneficial to have a tile drain which is modern, sleek, and attractive to consumers.

With modern interior design in mind, linear drains are often desirable for larger tile basins. Such linear drains are typically designed to extend from wall to wall within the basin. As such, linear drains are typically custom-ordered and manufactured to the specific length required for a particular basin, often requiring 4 to 6 weeks of lead time. This results in linear drains being extremely time consuming to install—usually requiring 4 to 6 weeks of wait time until a custom drain is manufactured—as well as very expensive. Some adjustable length linear drains have been developed, but such drains require the installer to piece together multiple "links" until the desired length of drain is obtained. This is extremely time consuming and cumbersome for the installer. In addition, the complexity and multiple components of such drains create a higher risk of improper installation and/or drain leakage. Therefore, it would be beneficial to provide a linear tile floor drain configured for easy installation in basins of varying dimensions.

Furthermore, some linear drains are incorporated into the base of a wall of a tile basin, which provide very sleek designs. Nevertheless, such prior art tile wall drains are generally expensive and/or difficult to install. It would be beneficial to have a tile wall drain which is sleek, attractive, easy to install, and reasonably priced.

Heretofore there has not been available a tile wall drain system or method with the advantages and features of the present invention.

SUMMARY OF THE INVENTION

The present invention comprises a tile drain system and method. In an exemplary embodiment, the tile drain system of the present invention is configured for installation at the base of a wall within a tile basin. In an exemplary embodiment, the tile drain system of the present invention comprises a vertical, linear drain system. In an exemplary embodiment, the present tile drain system includes a drain body made up of a main drain piece, drain extension piece(s), end cap(s), and magnet holder(s); a tile grate; and magnets.

In an exemplary embodiment, the body of the tile wall drain system is made up of polyvinyl chloride (PVC). In an exemplary embodiment of the present invention, the tile wall drain system is easy to cut to a desired size and to install into a tile basin.

In an exemplary embodiment of the tile wall drain system, a main drain piece includes an opening for engagement with a wastewater drain line. In an exemplary embodiment, the main drain piece is shaped such that an upright wall of the main drain piece flares inward around the drain opening. Such configuration provides more surface area around the drain opening to help facilitate drainage from the tile basin.

In an exemplary embodiment, an upper portion of the main drain piece comprises a stairstep-like shelf extending longitudinally along the length of the main drain piece. In an exemplary embodiment, the shelf is configured to receive and support gypsum board, also known as drywall, or another type of wall board. In an exemplary embodiment, at least a portion of the outward facing surface of the shelf is configured to engage with and/or be overlayed by one or more tiles of a tile wall.

In an exemplary embodiment, the tile wall drain system further comprises one or more drain extension pieces. In an exemplary embodiment, a drain system kit of the present invention comes with one long drain extension piece, which piece is configured to be cut into two pieces and each piece further cut as needed for a desired size for attachment on either side of the main drain piece, respectively. In alternative embodiments, a drain system kit of the present invention includes multiple drain extension pieces, each of which can be cut to size as desired and/or pieced together and connected with multiple extension pieces in series.

In an exemplary embodiment, the drain extension pieces are each configured to engage with an end of the main drain piece. In an exemplary embodiment, the drain extension pieces further include a stairstep-like shelf extending longitudinally along the length of the drain piece and configured to align with and connect to the shelf on the main drain piece.

In an exemplary embodiment, the tile wall drain system further comprises left and right end caps, each end cap configured for attachment to an end of a drain extension piece to seal off the ends of the drain.

In an exemplary embodiment, the tile wall drain system further comprises magnet holders. Such magnet holders each include a magnet housing and a tab configured for attachment to the main drain and/or an extension drain piece(s). In embodiments, each magnet holder is configured to house one or more magnets within the magnet housing. In an exemplary embodiment, magnet holder pieces are spaced along the longitudinal length of the drain system, and magnets housed within them are configured for magnetically interacting with magnets on a grate of the tile drain system.

In an exemplary embodiment, a grate of the present tile drain system is configured to be positioned over a portion of the drain system. In an exemplary embodiment, the grate is configured for positioning approximately in line with the tile wall of a tile basin between a bottom part of the wall and the floor of the basin. In an exemplary embodiment, the grate includes a series of magnets or is magnetic itself and configured for magnetic interaction with magnets housed within the magnet holder pieces. In an exemplary embodiment, the grate further includes a series of spacer legs configured to help position the grate above the floor of the tile basin and to allow water to flow beneath.

In an exemplary embodiment, the tile wall drain system is installed with wall board positioned on the drain system shelf. The drain system is configured such that tile can be placed over the wall board and over the front of the shelf portion of the drain, leaving a gap at the base of the wall to be filled by the drain system grate. In an exemplary embodiment, a tile floor can be installed abutting the drain system of the present invention. Preferably, the tile floor is installed with at least a slight slant toward the drain, such as over a slanted waterproofing foam layer. Once installed, the present tile wall drain system is configured to direct water from the tile basin in which it is installed to a corresponding waste-water drain line.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION OF THE DRAWINGS

Embodiments of the present invention are described in detail below with reference to the attached drawing figures, wherein.

Figure 1:
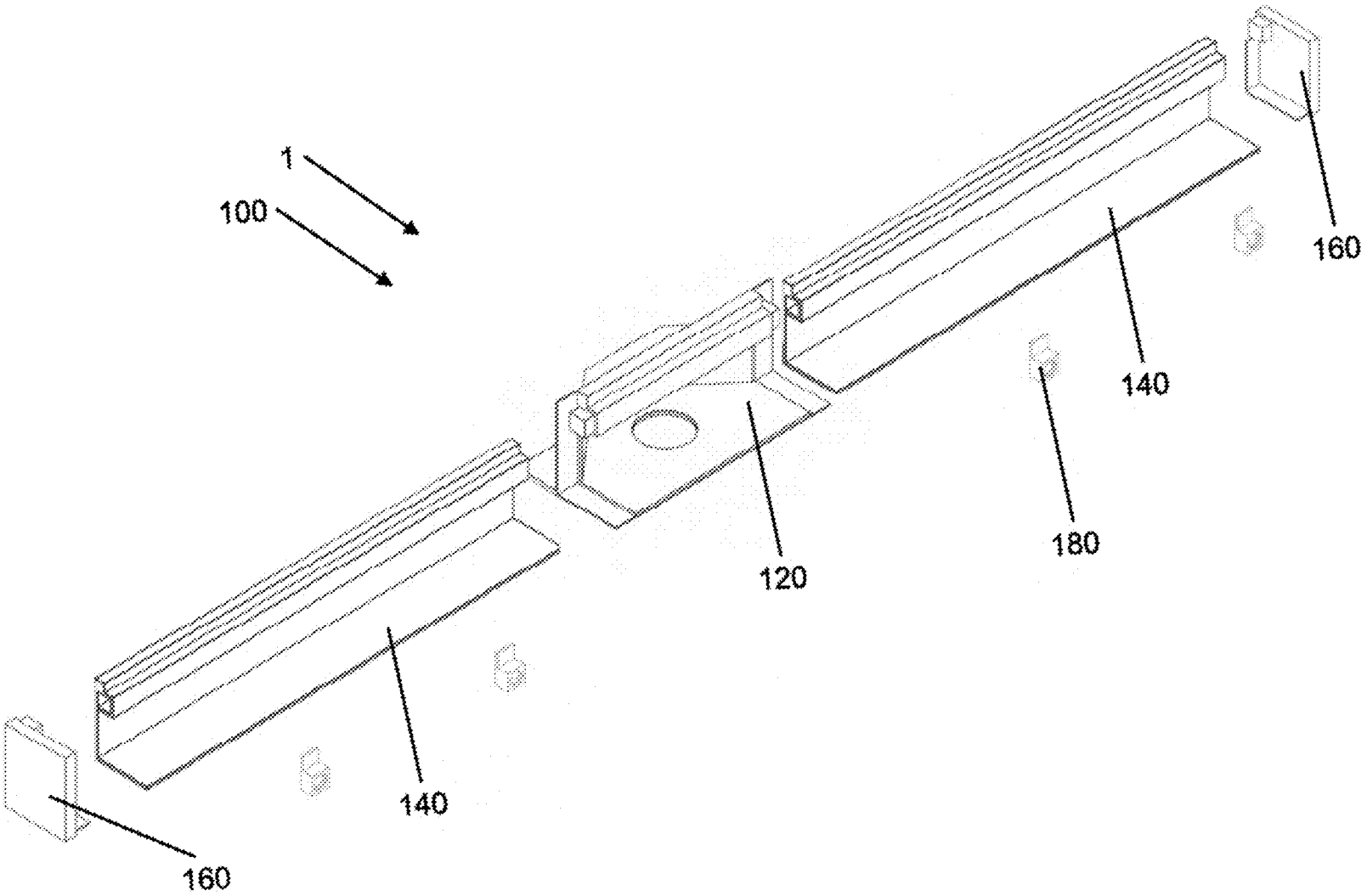
FIG. 1 is an upper, front, aligned, exploded, perspective view of a tile wall drain system embodying the present invention.
Figure 2:
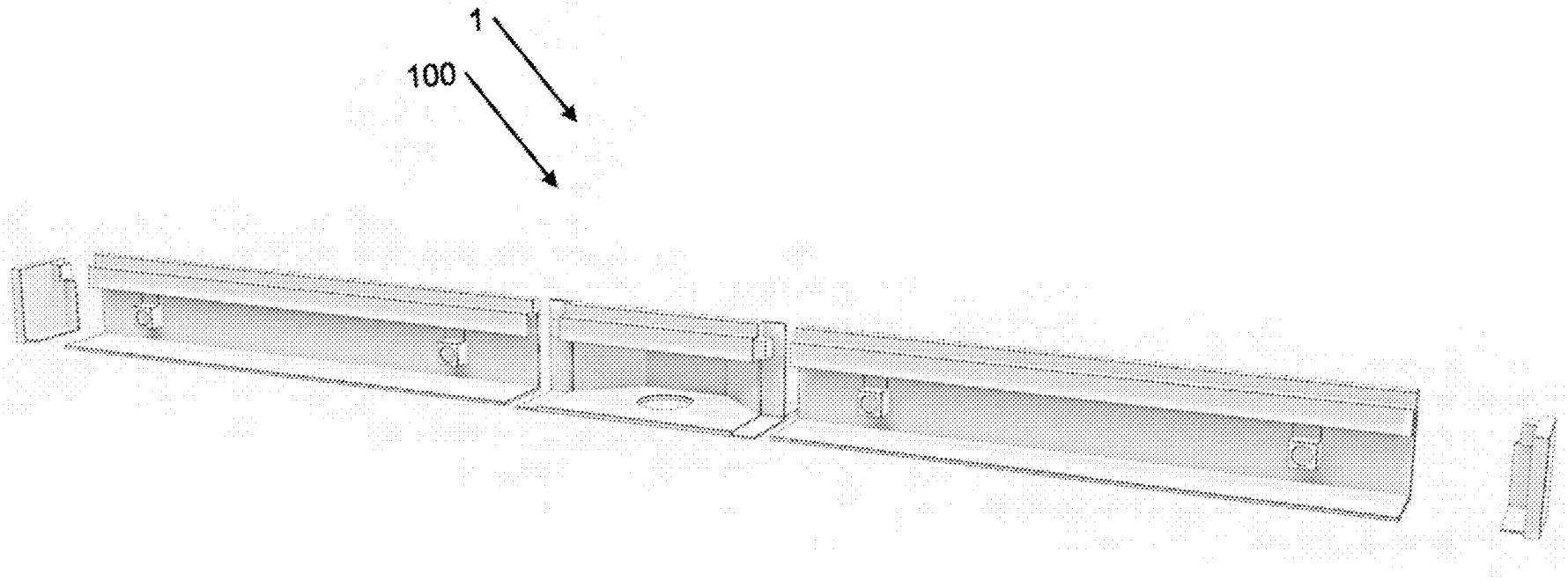
FIG. 2 is another upper, front, perspective view of the tile wall drain system with magnet holder pieces attached to drain body extension pieces.
Figure 3:
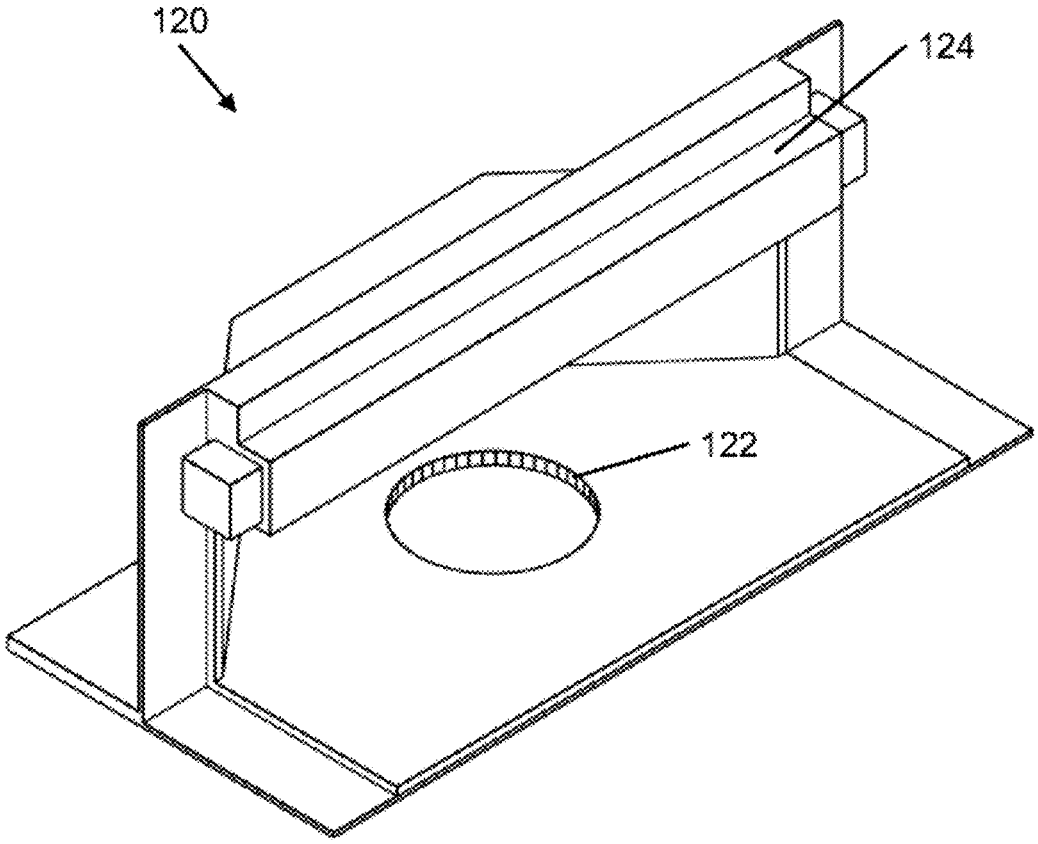
FIG. 3 is an upper, front, perspective view of a main drain piece of the tile wall drain system.
Figure 4:
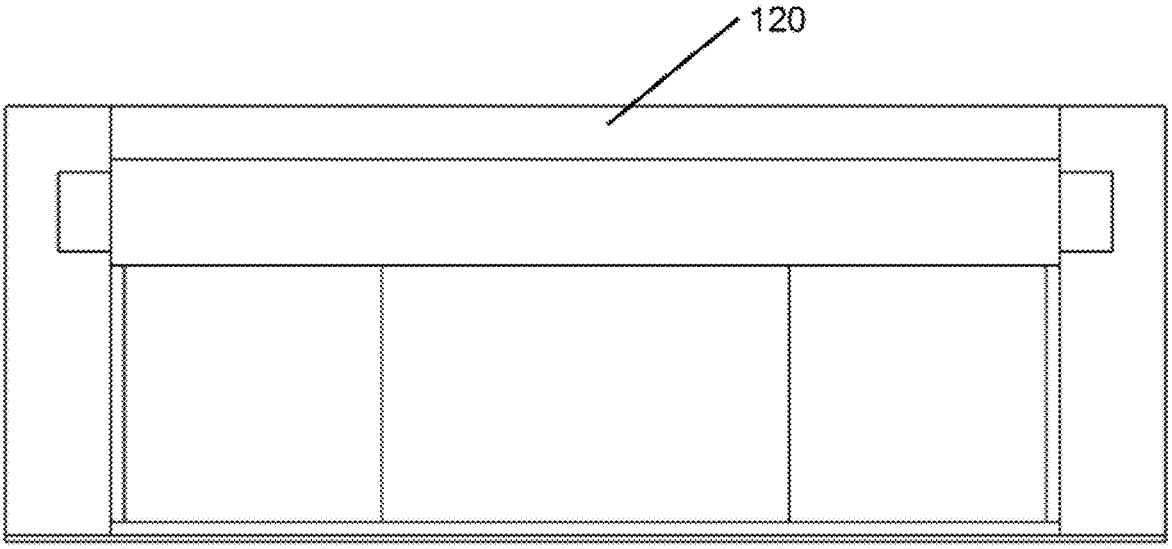
FIG. 4 is a front, elevational view of the main drain piece.
Figure 5:
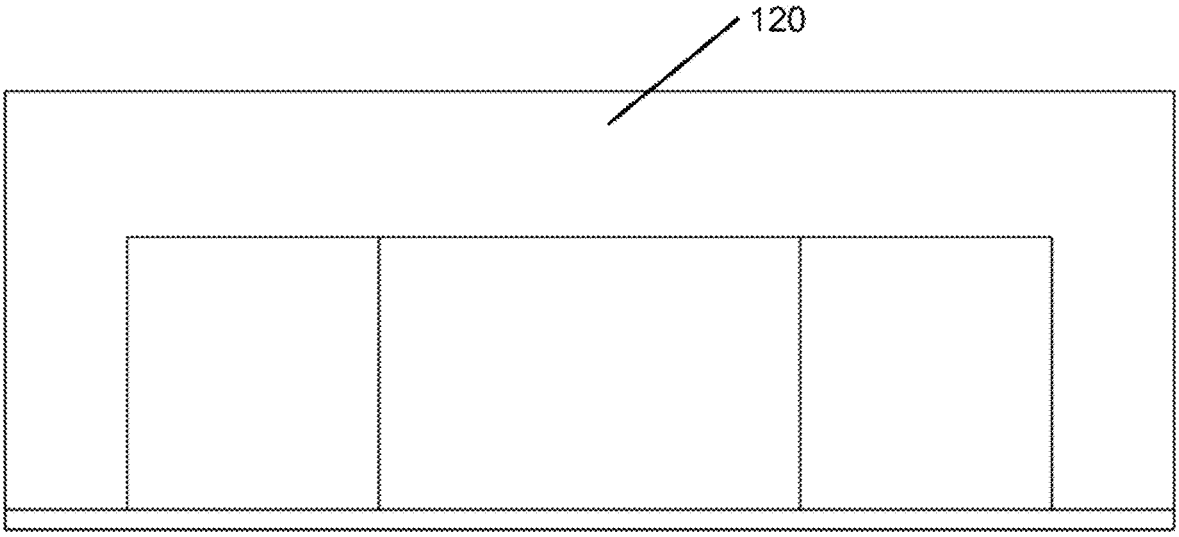
FIG. 5 is a back, elevational view of the main drain piece.
Figure 6:
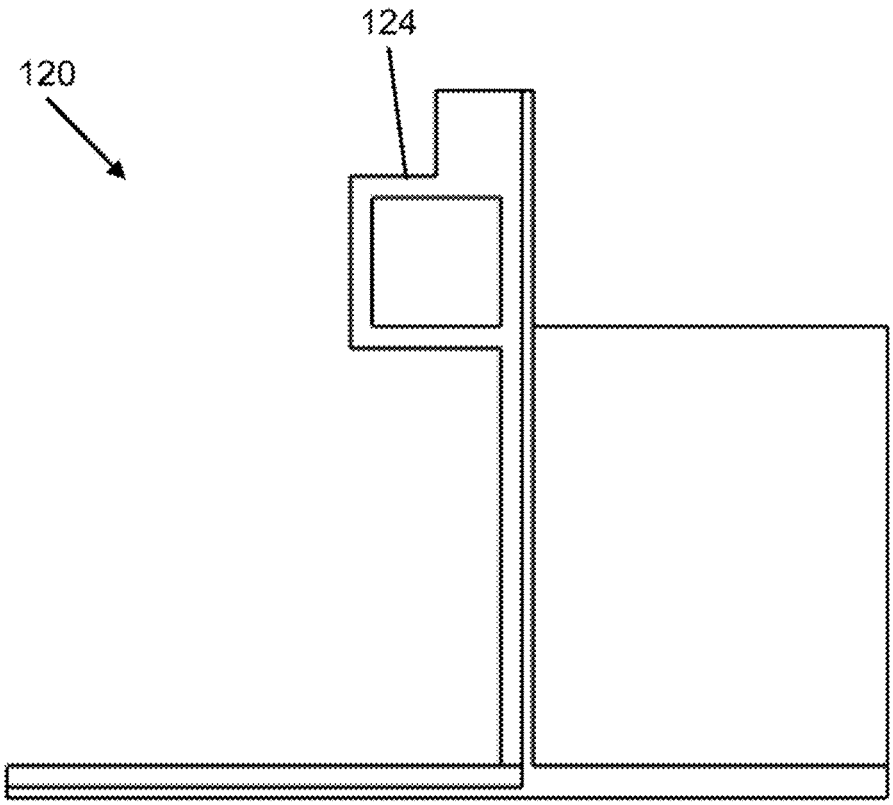
FIG. 6 is a side, elevational view of the main drain piece.
Figure 7:
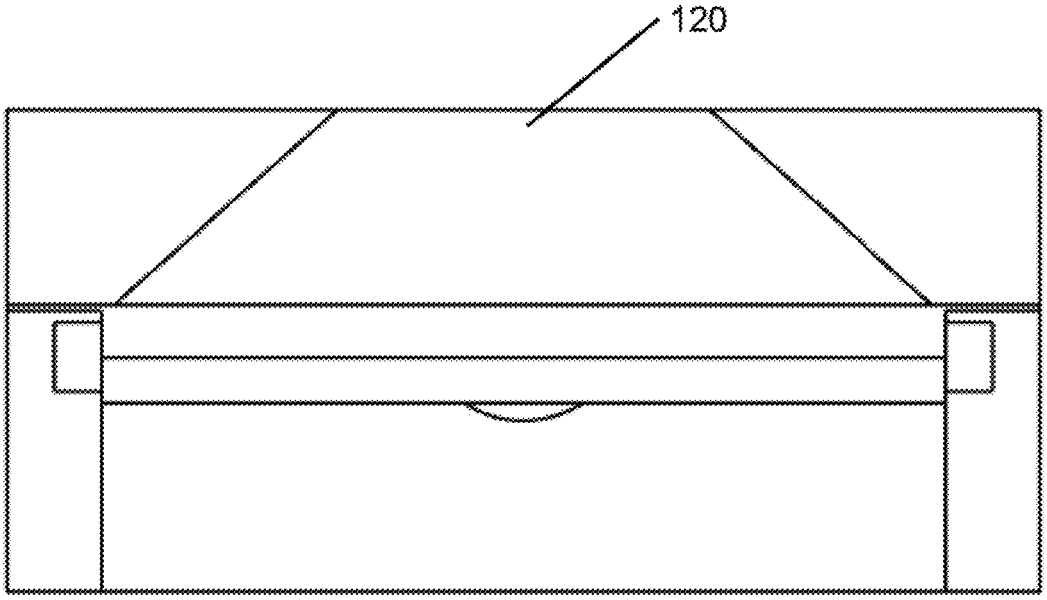
FIG. 7 is a top, plan view of the main drain piece.
Figure 8:
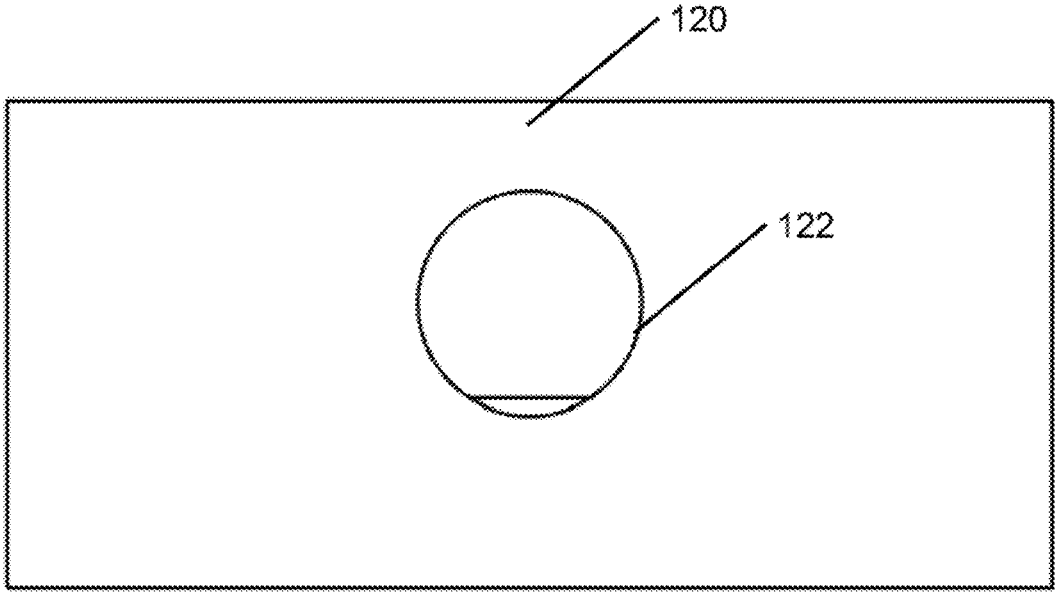
FIG. 8 is a bottom, plan view of the main drain piece.
Figure 9:
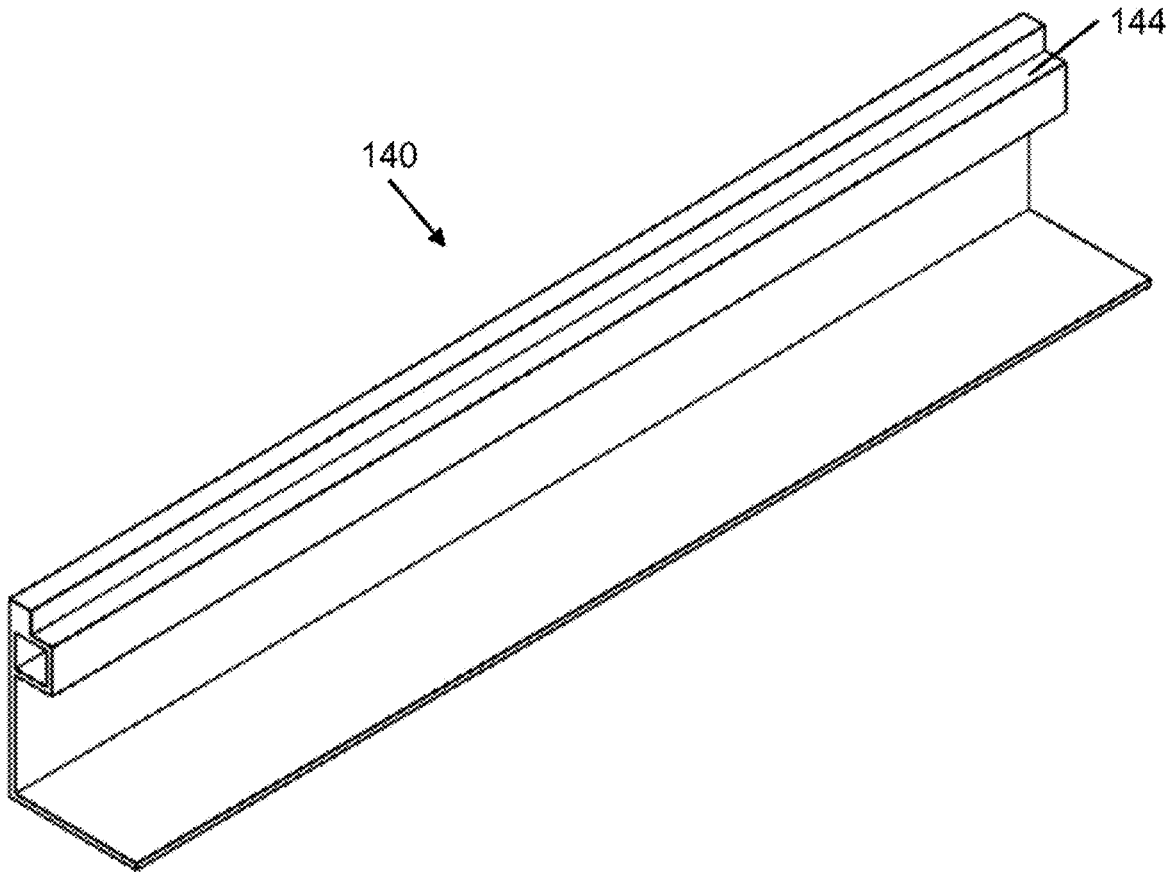
FIG. 9 is an upper, front, perspective view of a drain extension piece of the tile wall drain system.
Figure 10:
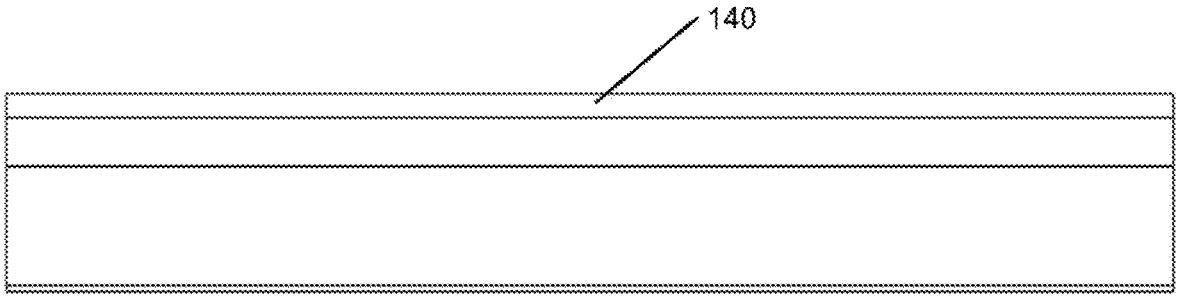
FIG. 10 is a front, elevational view of the drain extension piece.
Figure 11:
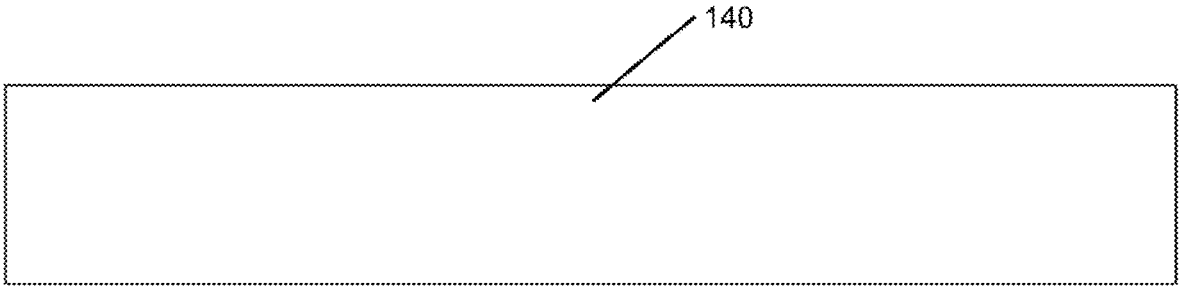
FIG. 11 is a back, elevational view of the drain extension piece.
Figure 12:
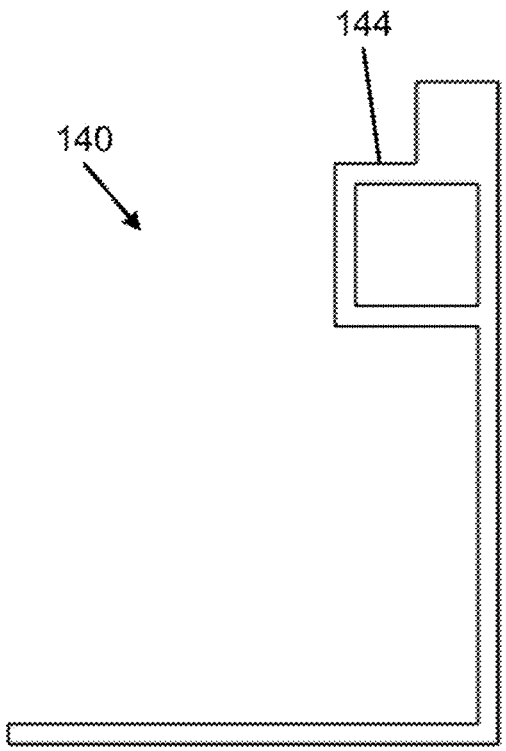
FIG. 12 is a side, elevational view of the drain extension piece.
Figure 13:
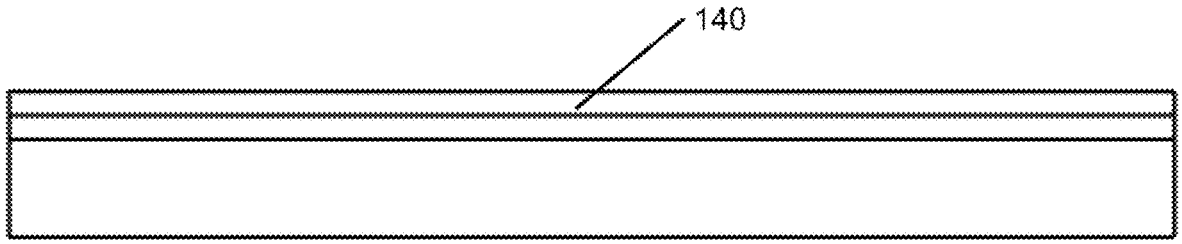
FIG. 13 is a top, plan view of the drain extension piece.
Figure 14:
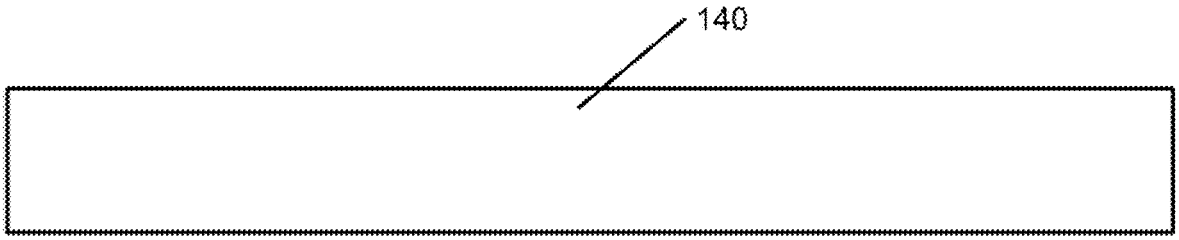
FIG. 14 is a bottom, plan view of the drain extension piece.
Figure 15:
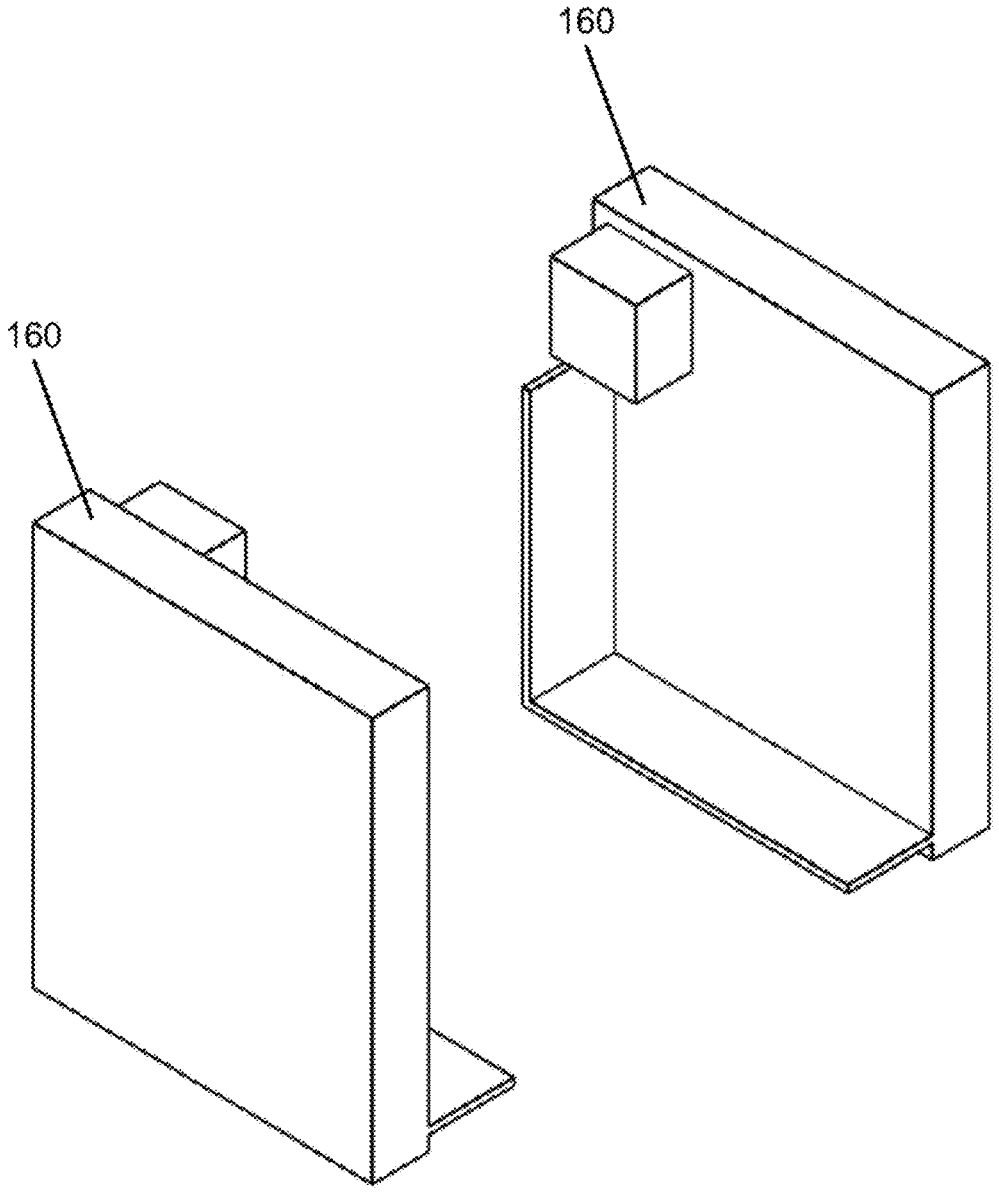
FIG. 15 is an upper, front, perspective view of left and right end caps of the tile wall drain system.
Figure 16:
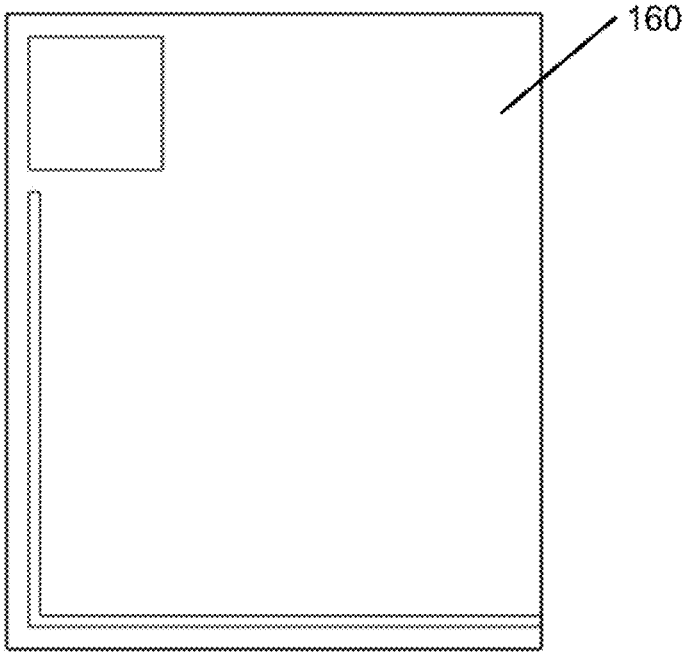
FIG. 16 is an inside, elevational view of an end cap of the tile wall drain system.
Figure 17:
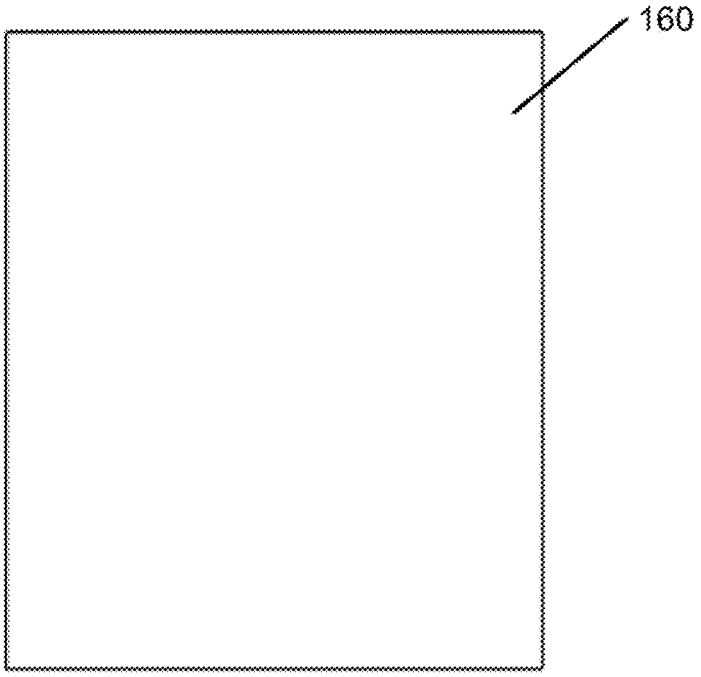
FIG. 17 is an outside, elevational view of an end cap of the tile wall drain system.
Figure 18:
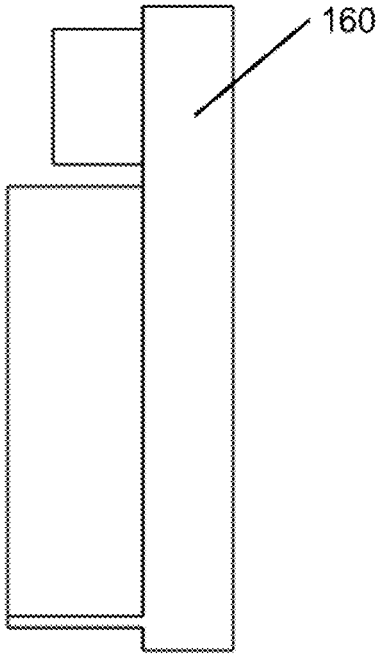
FIG. 18 is a front, elevational view of an end cap of the tile wall drain system.
Figure 19:
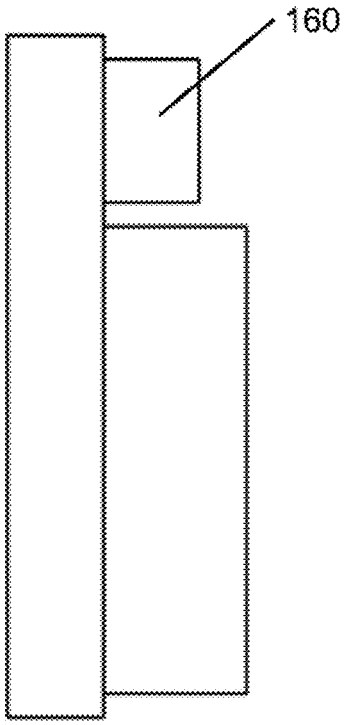
FIG. 19 is a back, elevational view of an end cap of the tile wall drain system.
Figure 20:
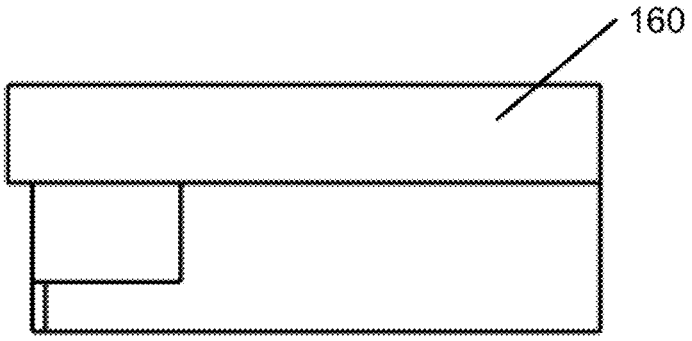
FIG. 20 is a top, plan view of an end cap of the tile wall drain system.
Figure 21:
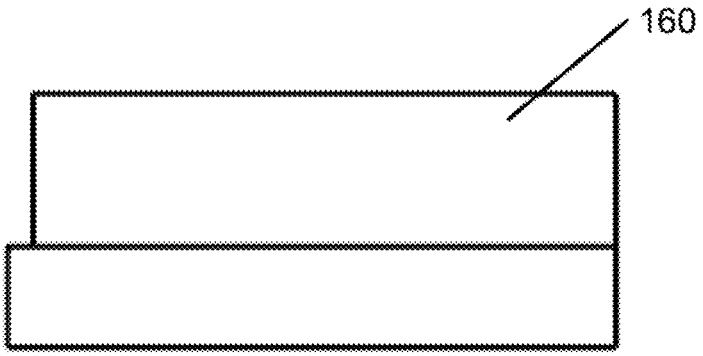
FIG. 21 is a bottom, plan view of an end cap of the tile wall drain system.
Figure 22:
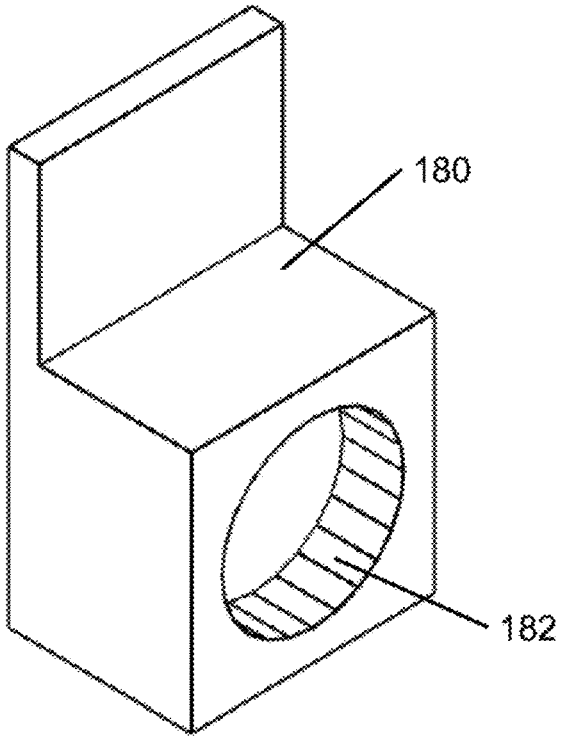
FIG. 22 is an upper, front, perspective view of a magnet holder piece of the tile wall drain system.
Figure 23:
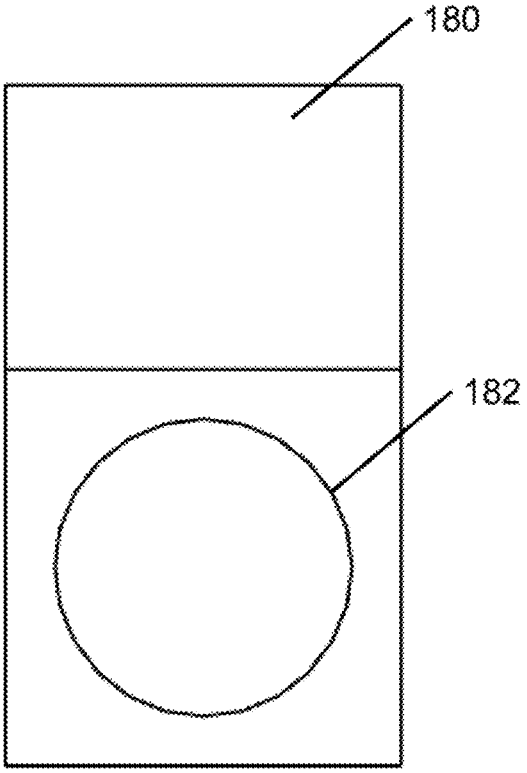
FIG. 23 is a front, elevational view of the magnet holder piece.
Figure 24:
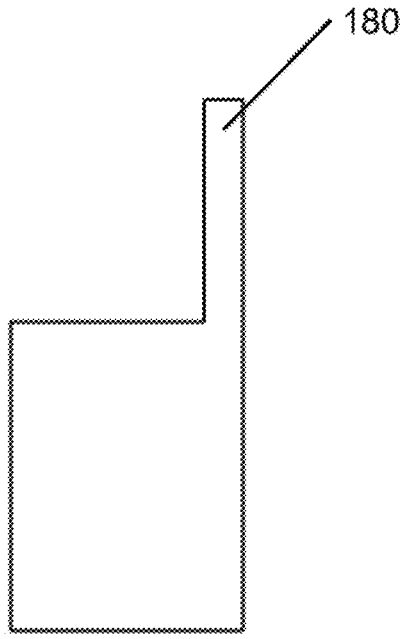
FIG. 24 is a side, elevational view of the magnet holder piece.

The drawing figures do not limit the present invention to the specific embodiments disclosed and described herein. The drawings are not necessarily to scale, emphasis instead being placed upon illustrating the principles of the invention.

DETAILED DESCRIPTION OF THE PREFERRED EMBODIMENTS

As required, a detailed embodiment of the present invention is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The present invention comprises a tile drain system and method. In an exemplary embodiment, the tile drain system of the present invention is configured for installation at the base of a wall within a tile basin. In an exemplary embodiment, the tile drain system of the present invention comprises a vertical, linear drain system. In an exemplary embodiment, at least a substantial portion of the tile wall drain system is configured to be installed behind an adjacent wall of the tile basin. In an exemplary embodiment of the present invention, a portion of the tile wall drain system is configured to be installed in line with a wall of a tile basin. In an exemplary embodiment, a base of the tile wall drain system is configured to engage with a floor of a tile basin.

FIGS. 1-26 show an exemplary embodiment of tile drain system 1 of the present invention. In this embodiment, the tile drain system 1 comprises a drain body 100 made up of a main drain piece 120, drain extension piece(s) 140, end cap(s) 160, and magnet holder(s) 180; a grate 200; and magnets 300.

As used herein, the drain body 100 of the tile drain system is defined as the portion of the tile drain system 1 not including a grate 200 and associated magnets 300. In an exemplary embodiment, the body 100 of the tile wall drain system is made up of polyvinyl chloride (PVC). In alternative embodiments, the body of the tile wall drain system is made up of any other rigid, watertight material. In an exemplary embodiment of the present invention, the tile wall drain system is easy to adjust to a desired size and to install into a tile basin.

FIGS. 1-8 show multiple views of a main drain piece 120 of the tile drain system. In an exemplary embodiment, the main drain piece 120 comprises a base connected to an upright wall positioned approximately perpendicular to the base. In an exemplary embodiment, the base of the main drain piece defines a drain opening 122 for engagement with a wastewater drain line, such as but not limited to a connection line to the sewer system, septic tank, or alternative drainage system. In an exemplary embodiment, the main drain piece 120 of the tile drain system is positioned generally in a central location along the longitudinal length of the drain system. In alternative embodiments, the main drain piece is positioned at any point along the longitudinal length of the drain system, depending on what is preferable for drainage to the wastewater drain line.

In exemplary embodiment, the main drain piece 120 is shaped such that the upright wall of the main drain piece includes a center portion which flares inward around the drain opening 122. Such configuration provides more surface area around the drain opening 122 to help facilitate drainage from the tile basin.

In an exemplary embodiment, an upper portion of the main drain piece upright wall comprises a stairstep-like shelf 124 extending longitudinally along the length of the main drain piece. In an exemplary embodiment, the shelf 124 is configured to receive and support gypsum board, also known as drywall, or another type of wall board.

In an exemplary embodiment, the main drain piece 120 further includes base and upright wall tab extensions on left and right ends of the main drain piece, each configured for engagement with an end of a drain extension piece.

FIGS. 1-2 and 9-14 show multiple views of a drain extension piece 140 of the present invention. In an exemplary embodiment, the tile wall drain system comprises one or more drain extension pieces 140. In an exemplary embodiment, each drain extension piece 140 includes a base connected to an upright wall positioned approximated perpendicular to the base. In an exemplary embodiment, the upright wall of the extension piece(s) is straight across, with no flared portion.

In an exemplary embodiment, a drain system kit of the present invention comes with one long drain extension piece 140, which piece is configured to be cut to a desired size and into two pieces for attachment on either side of the main drain piece 120, respectively. In embodiments, the long drain extension piece 140 is cut in half into two pieces equal in length. In other embodiments, the drain extension piece 140 is cut into segments which are not equal in size. In an exemplary embodiment, a long drain extension piece is configured for being cut into two pieces for use on either side of the main drain piece and the two extension pieces are configured to be further cut as needed to fit a particular tile basin. In further alternative embodiments, a drain system kit of the present invention includes multiple drain extension pieces, each of which can be cut to size as desired and/or pieced together and connected with multiple extension pieces in series. In an exemplary embodiment, the drain extension pieces are configured to engage with an end of the main drain piece.

In an exemplary embodiment, an upper portion of the drain extension piece upright wall includes a stairstep-like shelf 144 extending longitudinally along the length of the drain extension piece 140 and configured to align with and connect to the shelf 124 on the main drain piece 120. In an exemplary embodiment, the shelf 124 of the main drain piece includes male connectors on each end of the shelf. In this embodiment, the shelf 144 of each extension piece is hollow, forming a female connector configured for engaging and mating with the main drain piece shelf male connectors, one on either side of the main drain piece. In alternative embodiments, the extension piece shelves have male connectors and the main drain piece shelf is hollow forming female connectors on either end.

In an exemplary embodiment, drain extension piece(s) 140 of the present invention are attached to the main drain piece 120 with an adhesive. In embodiments, the drain extension piece(s) 140 are attached to main drain piece 120 of the drain system with a PVC adhesive. In alternative embodiments, the main drain piece 120 and extension piece(s) 140 fit together via compression fittings.

FIGS. 1-2 and 15-21 show an exemplary embodiment of end caps 160 of the present invention. In an exemplary embodiment, the tile wall drain system comprises left and right end caps 160, each end cap 160 configured for attachment to an end of a drain extension piece 140 and for sealing off the ends of the drain. In an exemplary embodiment, each end cap 160 includes an upright end wall connected to a tab for engaging with a drain extension piece 140 and a male connector configured for connecting to the extension piece shelf 144. In an alternative embodiment, the extension piece shelves include male connectors and each end cap includes a female connector configured for engagement with an extension piece shelf. In an exemplary embodiment, each end cap tab comprises a horizontal tab portion connected to a vertical tab portion.

In an exemplary embodiment, end cap(s) 160 of the present invention are attached to the drain extension piece(s) 140 with an adhesive. In embodiments, the end cap(s) 160 are attached to drain extension piece(s) 140 with a PVC adhesive. In alternative embodiments, the end cap(s) 160 and extension piece(s) 140 fit together via compression fittings.

FIGS. 1-2 and 22-24 show an exemplary embodiment of a magnet holder 180 of the tile drain system. In an exemplary embodiment, each magnet holder 180 defines a magnet housing 182 and further includes an upper tab configured for attachment to the main drain 120 and/or an extension drain piece(s) 140. In an exemplary embodiment, the magnet housing 182 is configured to hold one or more magnets therein. In an exemplary embodiment, the magnet housing 182 is open to the outside. In other embodiments, the magnet housing is open to the top, bottom, left, or right side or enclosed and selectively openable. In embodiments, magnets are held within the magnet housing via a compression fitting. In other embodiments, magnets are attached within the magnet housing with an adhesive or via any other attachment mechanism. In an exemplary embodiment, the magnet holder 180 pieces are attached to the main drain 120 and/or extension drain piece(s) 140 with an adhesive. In embodiments, the magnet holder pieces 180 are attached to the other pieces of the drain system with a PVC adhesive. In further embodiments, the magnet holder pieces 180 are attached to the other pieces of the drain system with fasteners or via any other attachment mechanism.

In an exemplary embodiment, magnet holder pieces 180 are spaced along the longitudinal length of the drain system, and magnets housed therein are configured for magnetically interacting with magnets on a grate or with a magnetic grate. In embodiments, one, two, three, four, five, six, seven, eight, nine, 10, 11, 12, 13, 14, 15, or any other number of magnet holders 180 are positioned along the length of the drain system.

Figure 25:
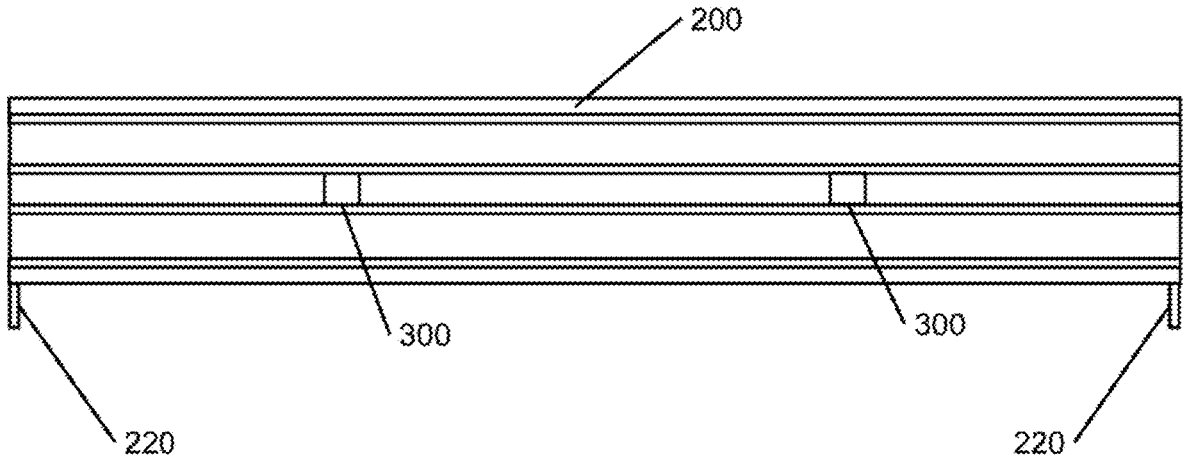
FIG. 25 is a front, elevational view of a grate of the tile wall drain system.

FIG. 25 shows an exemplary embodiment of a grate 200 of the present drain system. In an exemplary embodiment of the present invention, the grate 200 is configured to be positioned over a portion of the drain system. In an exemplary embodiment, the grate 200 is configured for positioning approximately in line with a tile wall of a tile basin between a bottom part of the wall and the floor of the tile basin. In an exemplary embodiment, the grate 200 is made up of metal and includes a series of magnets or is magnetic itself and configured for magnetic interaction with magnets housed within magnet holder pieces of the present invention. In other embodiments, the grate may be made of plastics or any other material. In an exemplary embodiment, the grate 200 further includes two or more spacer legs 220 configured to help position the grate 200 above the floor of the tile basin and to allow water to flow beneath. In embodiments, one, two, three, four, five, six, seven, eight, nine, 10, 11, 12, 13, 14, 15, or any other number of spacer legs 220 are positioned on the grate 200 along the length of the drain system. In embodiments, such spacer legs 220 are height adjustable.

In alternative embodiments, the drain system of the present invention does not include magnet holders or magnets. In embodiments, a grate of the drain system is configured to connect to the drain body by compression fittings, clasps, fasteners, or any other attachment mechanism.

In an exemplary embodiment, the tile drain system is installed with wall board positioned on the shelf of the main drain piece and drain extension piece(s). In an exemplary embodiment, the drain system is configured such that tile can be placed over the wall board and over at least a portion of the front, outward-facing surface of the shelf portion of the drain, leaving a gap at the base of the wall to be filled by the drain system grate. In an exemplary embodiment, a tile floor can be installed abutting the drain system of the present invention. Preferably, the tile floor is installed with at least a slight slant toward the drain, such as over a slanted waterproofing foam layer. Once installed, the present tile wall drain system is configured to direct water from the tile basin in which it is installed to a corresponding wastewater drain line.

Figure 26:
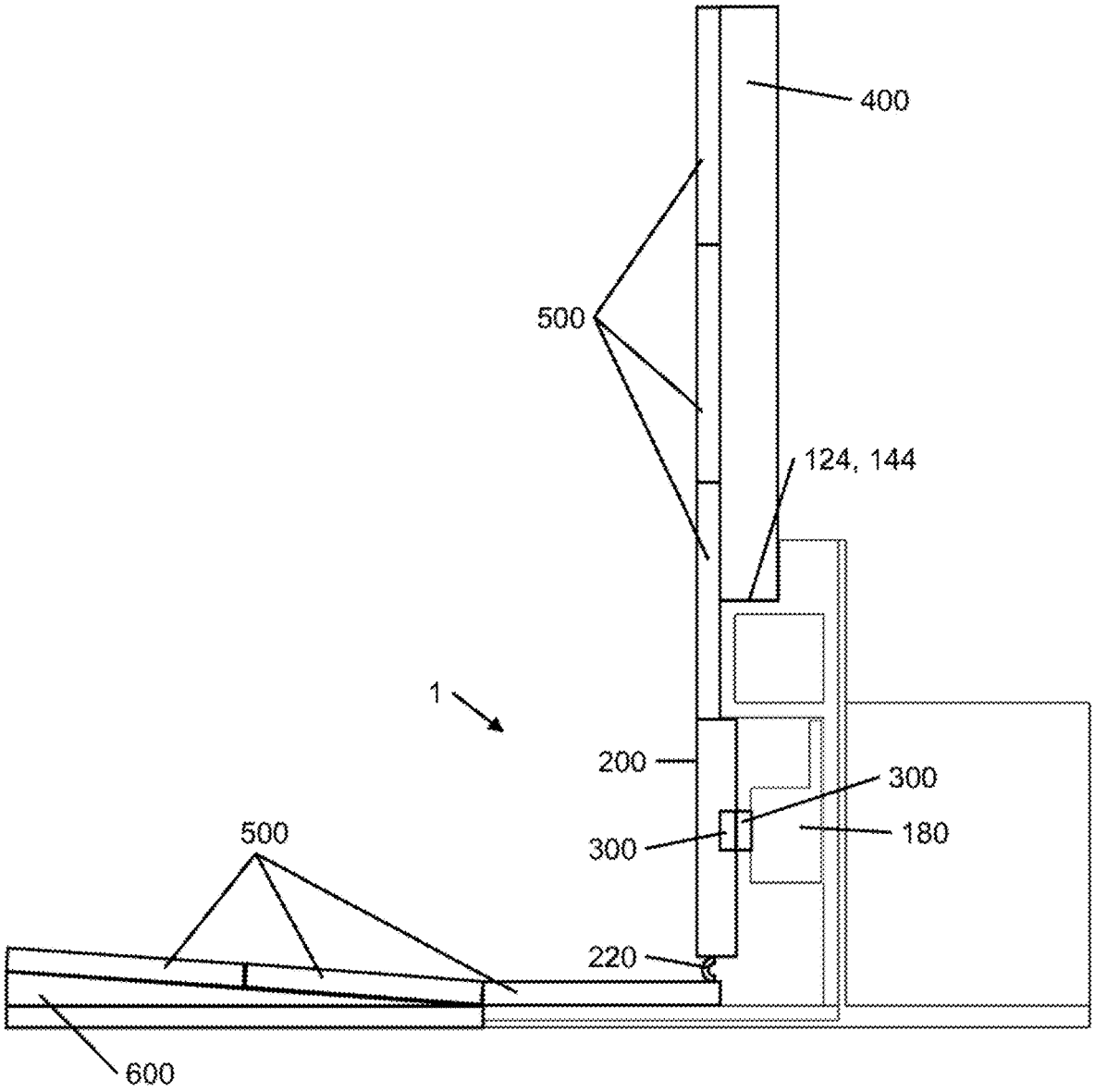
FIG. 26 is side, cross-sectional, elevational view of an exemplary embodiment of a tile wall drain system of the present invention and surrounding environment of use.

FIG. 26 shows an exemplary embodiment of a tile drain system 1 of the present invention installed within a tile basin. In such embodiment, portions of the tile drain system 1 are positioned beneath and behind tile 500 of a tile floor and tile wall. Furthermore, the drain system is configured to engage with a drywall or gypsum board wall 400. The drain body 100 is positioned such that drywall or gypsum board 400 is positioned on the shelf 124, 144 of the drain body. Tiles 500 of a tile wall are placed over the drywall or gypsum board 400 and over the outward-facing surface of the drain body shelf 124, 144, leaving a gap at the bottom of the wall to be filled by the drain system grate 200. One or more magnet holder(s) 180 housing a magnet 300 are attached to the drain body 100 and configured to magnetically interact with one or more magnets 300 on the grate 200 of the drain system. In this embodiment, tiles 500 of an adjacent tile floor are positioned on a slanted waterproofing foam 600 to further direct water from the tile basin to the drain.

Certain terminology is used in the description for convenience in reference only and will not be limiting. For example, up, down, front, back, right, and left refer to the invention as orientated in the view being referred to. The words "inwardly" and "outwardly" refer to directions toward and away from, respectively, the geometric center of the aspect being described and designated parts thereof. Forwardly and rearwardly are generally in reference to the direction of travel, if appropriate. Additionally, anatomical terms are given their usual meanings. For example, proximal means closer to the trunk of the body, and distal means further from the trunk of the body. Said terminology shall include the words specifically mentioned, derivatives thereof, and words of similar meaning.

As used in this specification and the appended claims, the singular forms "a", "an", and "the" include plural references unless the context clearly dictates otherwise. Thus, for example, a reference to "a method" includes one or more methods, elements, and/or steps of the type described herein and/or which will become apparent to those persons skilled in the art upon reading this disclosure and so forth.

As used in this specification and the appended claims, the use of the term "about" means a range of values including and within 15% above and below the named value, except for nominal temperature. For example, the phrase "about 3 mM" means within 15% of 3 mM, or 2.55-3.45, inclusive. Likewise, the phrase "about 3 millimeters (mm)" means 2.55 mm-3.45 mm, inclusive. When temperature is used to denote change, the term "about" means a range of values including and within 15% above and below the named value. For example, "about 5° C.," when used to denote a change such as in "a thermal resolution of better than 5° C. across 3 mm," means within 15% of 5° C., or 4.25° C.-5.75° C. When referring to nominal temperature, such as "about −50° C. to about +50° C.," the term "about" means ±5° C. Thus, for example, the phrase "about 37° C." means 32° C.-42° C.

Unless defined otherwise, all technical and scientific terms used herein have the same meaning as commonly understood by one of ordinary skill in the art to which this invention belongs. Although any systems, elements, methods and materials similar or equivalent to those described herein can be used in the practice or testing of the present invention, the preferred systems, elements, and methods and materials are now described. All publications mentioned herein are incorporated herein by reference to describe in their entirety.

"Substantially" means to be more-or-less conforming to the particular dimension, range, shape, concept, or other aspect modified by the term, such that a feature or component need not conform exactly. For example, a "substantially cylindrical" object means that the object resembles a cylinder but may have one or more deviations from a true cylinder. "Comprising," "including," and "having" (and conjugations thereof) are used interchangeably to mean including but not necessarily limited to, and are open-ended terms not intended to exclude additional, unrecited elements or method steps.

Changes may be made in the above methods, devices and structures without departing from the scope hereof. Many different arrangements of the various components depicted, as well as components not shown, are possible without departing from the spirit and scope of the present invention. Embodiments of the present invention have been described with the intent to be illustrative and exemplary of the invention, rather than restrictive or limiting of the scope thereof. Alternative embodiments will become apparent to those skilled in the art that do not depart from its scope. Specific structural and functional details disclosed herein are not to be interpreted as limiting, but merely as a representative basis for teaching one of skill in the art to employ the present invention in any appropriately detailed structure. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

It is also to be understood that the following claims are intended to cover all of the generic and specific features of the invention herein described, and all statements of the scope of the invention which, as a matter of language, might be said to fall therebetween.

Having thus described the invention, what is claimed as new and desired to be secured by Letters Patent is:

1. A drain system comprising:

a drain body comprising first and second ends and having a base connected to an upright wall, the base defining a drain opening and the upright wall comprising an elongated shelf extending from said first end to said second end;

wherein said drain body comprises a main drain piece connected to a drain extension piece and an end cap connected to said drain extension piece;

wherein said elongated shelf comprises connectors configured for engagement of said main drain piece with said drain extension piece and engagement of said drain extension piece with said end cap with said elongated shelf aligned from said first end to said second end;

wherein said main drain piece includes said drain opening;

wherein a top surface of said elongated shelf is configured to receive and support a wall board; and wherein said drain system is configured for installation at a bottom section of a tile wall.

2. The drain system of claim 1, wherein:

a portion of said drain system is configured to be overlayed by one or more tiles of the tile wall.

3. The drain system of claim 1, wherein:

said drain extension piece comprises a first drain extension piece;

said drain body further comprises a second drain extension piece connected to said main drain piece; and said first drain extension piece and said second drain extension piece are connected to said main drain piece on opposite sides of said main drain piece.

4. The drain system of claim 3, wherein:

said end cap comprises a first end cap; and said drain body further comprises a second end cap connected to said second drain extension piece.

5. The drain system of claim 1, wherein:

said drain body further comprises one or more magnet holders, each magnet holder configured to house a magnet along the longitudinal length of the drain body.

6. The drain system of claim 5, further comprising:

a grate configured to magnetically interact with each said magnet within each said magnet holder.

7. The drain system of claim 1, further comprising:

a grate configured for connection to said drain body.

8. The drain system of claim 7, wherein:

said grate further comprises two or more spacer legs.

9. The drain system of claim 7, wherein:

said grate is configured to be positioned vertically and approximately in line with said tile wall.

10. The drain system of claim 1, wherein:

said main drain piece further comprises a portion of said upright wall which flares inward around said drain opening creating more surface area around said drain opening.

11. The drain system of claim 1, wherein said connectors comprise a male connector on said main drain piece, first and second female connectors on said drain extension piece, and a male connector on said end cap.

12. A drain system kit comprising:

a main drain piece having first and second ends and defining a drain opening;

an elongated drain extension piece configured for being cut into a first drain extension piece and a second drain extension piece;

wherein said first drain extension piece is configured to connect to the first end of said main drain piece and said second drain extension piece is configured to connect to the second end of said main drain piece via connectors of an elongated shelf formed and extending from a first end to a second end of said drain system;

a first end cap and a second end cap, wherein said first end cap is configured to connect to the first drain extension piece via a first end cap connector in line with said elongated shelf and said second end cap is configured to connect to the second drain extension piece via a second end cap connector in line with said elongated shelf;

wherein said drain system is configured for installation at a bottom section of a tile wall; and wherein a top surface of said elongated shelf is configured to receive and support a wall board.

13. The kit of claim 12, further comprising:

an adhesive configured to sealingly attach pieces of said drain system together.

14. The kit of claim 12, further comprising:

a grate configured for attachment to said main drain piece and said first and second drain extension pieces;

wherein said grate is configured to be positioned vertically and approximately in line with a tile wall.

15. The kit of claim 12, further comprising:

one or more magnet holders, each magnet holder configured to house a magnet; and wherein each said magnet holder is configured for attachment to said main drain piece, said first drain extension piece, or said second drain extension piece along the longitudinal length of the drain system.

16. The kit of claim 15, wherein:

said magnets are configured to magnetically interact with a grate.

17. The kit of claim 12, wherein said connectors comprise male connectors on said main drain piece, female connectors on said first and second drain extension pieces, and male connectors on said first and second end caps.

* * * * *